United States Patent [19]

ten Broeke et al.

[11] Patent Number: 4,524,874

[45] Date of Patent: Jun. 25, 1985

[54] TOWER CRANE WITH OVERBOOMING PROTECTION

[75] Inventors: Klaas E. ten Broeke, Darien, Conn.; Manfred R. Kohler, Somers, N.Y.

[73] Assignee: American Pecco Corporation, Milwood, N.Y.

[21] Appl. No.: 512,248

[22] Filed: Jul. 11, 1983

[51] Int. Cl.[3] ..... B66C 23/72

[52] U.S. Cl. ..... 212/197; 212/222; 212/151; 212/239

[58] Field of Search ..... 212/151, 195–198, 212/222, 239, 262, 191

[56] References Cited

U.S. PATENT DOCUMENTS

| | | | |
|---|---|---|---|
| 849,078 | 4/1907 | Moss | 212/196 |
| 2,364,493 | 12/1944 | Vlinski | 212/195 |
| 2,408,500 | 10/1946 | West | 212/196 |
| 3,304,634 | 2/1967 | Becker | 212/196 |
| 3,530,999 | 9/1970 | Naruns | 212/197 |
| 3,998,336 | 12/1976 | Tax et al. | 212/197 |

FOREIGN PATENT DOCUMENTS

| | | | |
|---|---|---|---|
| 464353 | 6/1951 | Italy | 212/196 |

*Primary Examiner*—Trygve M. Blix
*Assistant Examiner*—Stephen P. Avila
*Attorney, Agent, or Firm*—Owen, Wickersham & Erickson

[57] ABSTRACT

A tower crane with a counterweighted luffing boom has its counterweight lines and pulleys so arranged that, in normal operating positions of the boom, the counterweights and lines tend to swing the boom upwardly, but when the boom angle is steep, beyond about 70° from the horizontal, the counterweights and lines then pull on the boom in the opposite direction, tending to retard further upward travel. The boom and supporting structure are thereby protected against overbooming by wind forces when the boom is inclined at a very steep angle facing into the wind.

5 Claims, 3 Drawing Figures

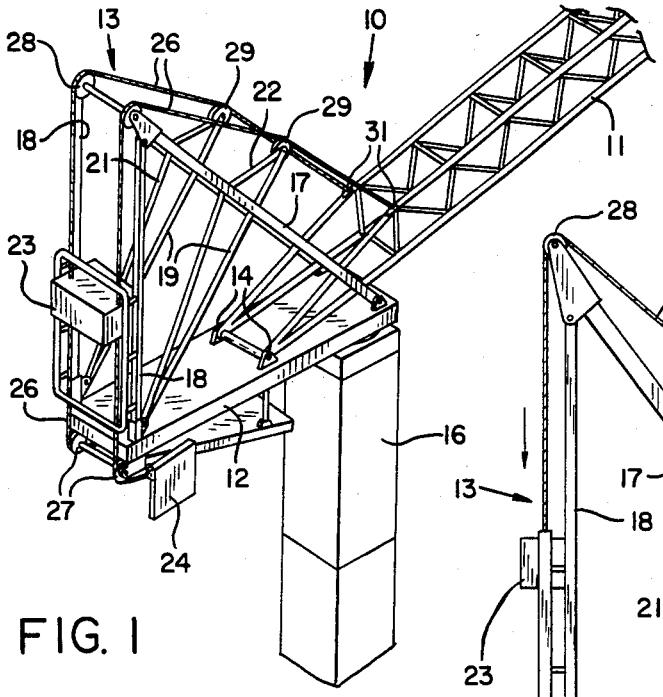
FIG. 1
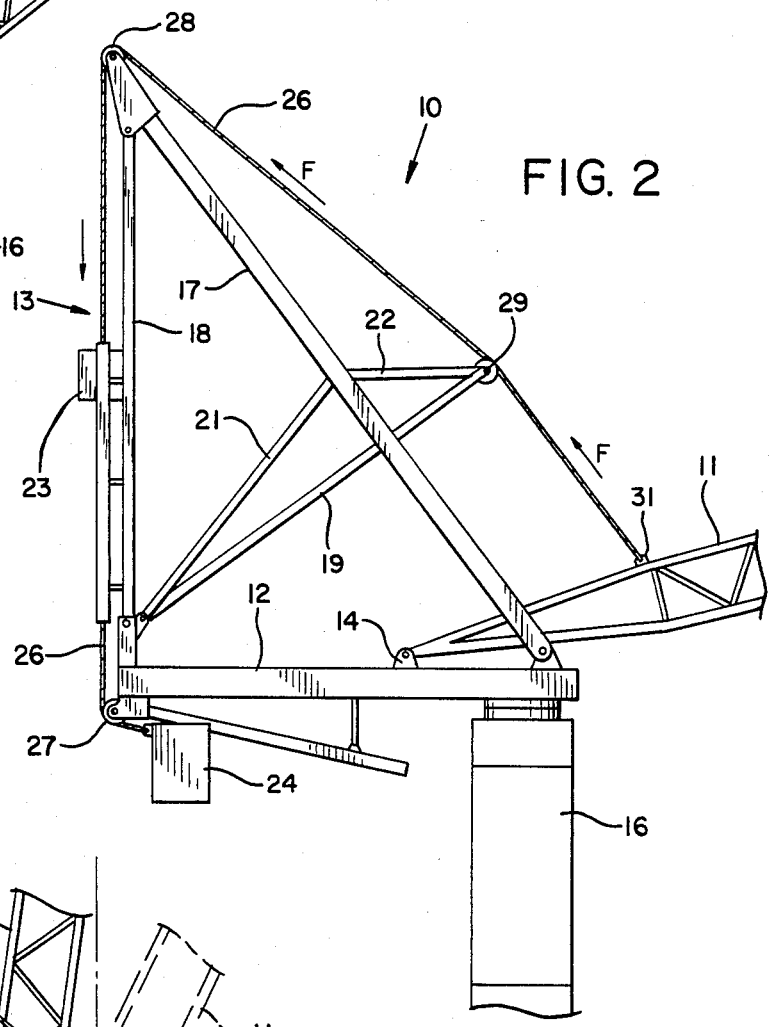
FIG. 2
FIG. 3
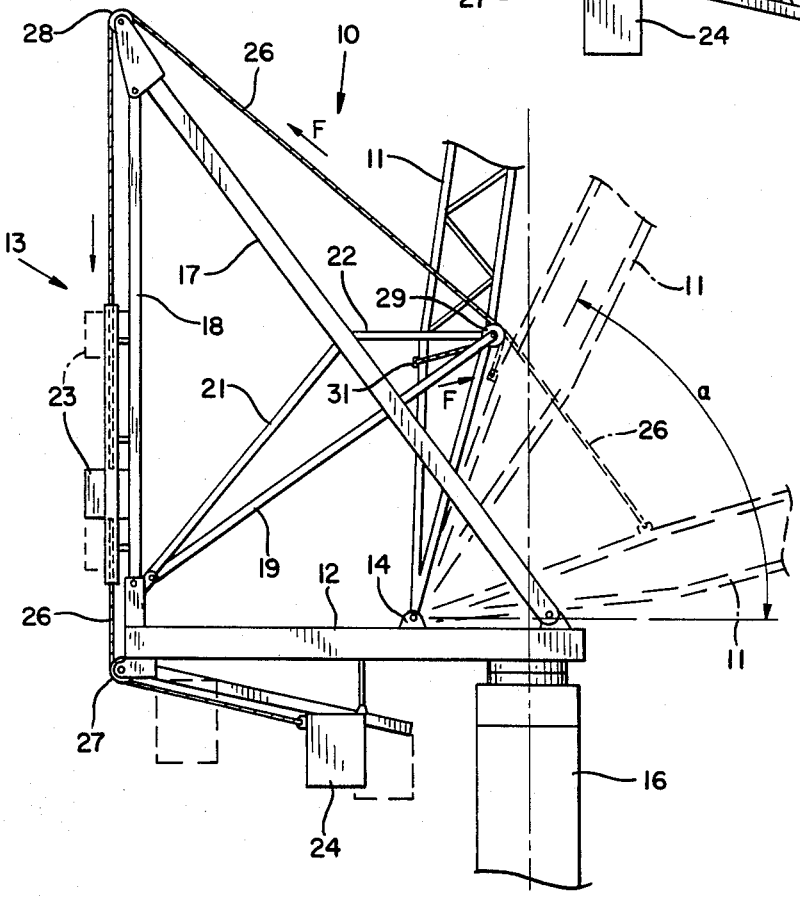

TOWER CRANE WITH OVERBOOMING PROTECTION

BACKGROUND OF THE INVENTION

The invention relates to tower cranes, and more particularly to tower cranes of the type having a counterweighted luffing boom. The invention is concerned with stabilization of such a luffing boom when at a steep angle of inclination, to prevent wind forces from pushing the boom backward past the vertical.

During normal operation of a conventional luffing boom tower crane, during which the boom angle, or the angle with the horizontal, is approximately 75° or less, the crane boom is urged in the upwardly pivoting direction by means of cables or lines which are run over a series of sheaves to one or more counterweights. The counterweights tend to lift the boom up or reduce the weight of the boom, to thereby ease the strain on the boom luffing mechanism, so that the boom angle adjustment motor may be smaller than otherwise would have been required.

In tower cranes of typical prior art configuration, when the boom is raised quite steeply, past approximately a 75° angle of inclination, wind forces acting on the boom can be critical. When the boom is facing into the wind at such a steep angle, close to vertical, wind forces tend to blow the boom over backward, which would result in damage to the structure. To avoid this problem, the crane operator was required to limit the boom angle, or simply to restrict crane operation to days when the wind speed was minimal, severely limiting the use of the crane.

It is an object of the present invention to eliminate this problem by arranging a system of counterweight cables and sheaves or pulleys on a tower crane structure such that beyond a certain angle of inclination, the counterweights tend to retard further upward movement of the boom, rather than pulling upward on the boom as in normal operation, when the boom angle is not so steep.

SUMMARY OF THE INVENTION

According to the present invention, a crane having a counterweighted luffing boom includes protection against overbooming, as by excessive wind force when the boom is at a steep angle close to vertical. The crane has a supporting structure, on which the luffing boom is pivotally mounted at a pivot point, with a series of sheaves mounted on the supporting structure. At least one counterweight is connected to a line and over the sheaves to a connection with the boom at a point spaced from the boom's pivot point. A portion of the supporting structure of the crane apparatus supports one of the sheaves adjacent to but out of the path of travel of the luffing boom, the one sheave being that closest to the point of connection with the boom. The positioning of the sheave and the line connection point is such that the line and counterweight pull on the boom tending to swing it upward in its path of travel until the line connection point on the boom passes the one sheave, after which the boom is oriented steeply and close to vertical, and the line then pulls on the boom in the opposite direction, tending to retard further upward travel.

Preferably there are two counterweight lines or cables, on left and right, and two corresponding series of sheaves. The boom is preferably pivoted from its end, with the nearest pair of sheaves positioned just outside the boom's path of travel, so that when the boom pivots upwardly past a predetermined boom angle such as approximately 70° from horizontal, the counterweight lines loop around the closest sheaves and pull in the opposite direction on the boom so that the counterweights then tend to hold back the boom from further upward pivoting.

The boom stabilization system of the invention thereby prevents or greatly lessens the risk of overbooming when a crane faces into a strong wind at a high boom angle, with a very simple and economical arrangement of counterweight lines and sheaves. These and other objects, advantages and features of the invention will be apparent from the following description of a preferred embodiment, considered along with the accompanying drawings.

DESCRIPTION OF THE DRAWINGS

FIG. 1 is a perspective view showing pertinent portions of a luffing boom tower crane according to the invention, with the boom at a relatively low position as typical in operation.

FIG. 2 is a side elevation view showing important portions of the crane, with the boom in the same position as in FIG. 1.

FIG. 3 is a side elevation view of the crane with the boom raised to a steep angle of inclination, approaching vertical, and illustrating the stabilization system of the invention whereby the crane is protected from overbooming due to wind forces.

DESCRIPTION OF A PREFERRED EMBODIMENT

In the drawings, FIG. 1 shows a tower crane 10 according to the invention having a luffing boom 11 pivotally connected to a platform 12 of crane structure 13 along a horizontal pivot axis 14. Although a tower crane is shown and described herein, any type of crane having a luffing boom wherein the boom is allowed to approach the vertical can incorporate the features of the present invention.

As depicted, the crane 10 includes a crane tower 16 onto which the platform 12 is pivotally connected, and a series of pairs of struts 17, 18, 19, 21 and 22 connected to the platform 12 and making up the supporting structure 13. The luffing motor, cable and mechanism are not shown in the drawings, since they do not form a part of this invention.

A system of counterweights 23 and 24 includes cables or lines 26 which transfer the weight of the counterweights over sheaves 27, 28 and 29, in corresponding pairs as illustrated, as pulling force to the boom 11, via connection points 31. The counterweights shown, a vertically acting weight 23 and a pair of oblique angle sliding weights 24, are mounted on the crane 10 in a manner which is typical for conventional tower cranes. The counterweight lines 26 pass over the sheaves 28, mounted at a high point or apex of the supporting structure 13, then pass obliquely downwardly and over sheaves 29 which are closest to the boom 11. The sheaves 29 are supported by the structural members 19 and 22 such that they are positioned adjacent to but just outside of the boom's path of travel.

FIG. 2 shows the crane 10 in profile, with the boom 11 in approximately the same position as in FIG. 1, slightly raised in a typical operating position. As indicated, the counterweight pulling force F in the counterweight lines 26 pulls in the upwardly angling direction on the boom 11, via the line connection point 31 in this configuration of the crane. The angle a of the sheaves 29 with respect to the boom pivot point 14 and the horizontal is important. The angle a should be such that, when the line connection point 31 reaches the sheave 29 in the path of swinging travel of the boom 11, the boom will be at a preselected angle with respect to the horizontal. The boom angle may be approximately 70°, although somewhat smaller angles can be selected to be more conservative, as where wind forces can be expected to be quite large. The line connection points 31 are spaced away from the boom pivot point 14 a slightly smaller distance than the distance of the sheave 29 from the pivot point 14, so that the connection points 31 pass directly under the sheaves 29. The connection points 31 are configured to hold the counterweight lines 26 laterally outwardly a slight distance from the boom 11, so that each line 26 will lie substantially in a single vertical plane and the connection point 31 will pass directly under the sheave 29.

This seen in FIG. 3, wherein the luffing boom 11 has been swung upwardly to a very steep angle of inclination, approaching vertical. The boom has passed between the pairs of struts 19 and 22 and sheaves 29, and each line connection point 31 is now behind the nearest sheave 29, so that the counterweight line 26 now loops over the sheave 29 and back to the connection point 31, the force F now acting in the opposite direction on the boom 11, as indicated. Thus, the force F tends to retard further upward movement of the boom 11, protecting the boom and structure 13 against overbooming when facing a strong wind.

It should be understood that the principle illustrated and described herein, i.e. the arrangement of sheaves and counterweight lines such that the force on the boom is reversed past a certain point of steep inclination of the boom, is not limited to the type of tower crane 10 shown in these drawings. The principle of the invention can be applied to a luffing boom having a pivot point which is not at its end, but rather intermediate the ends (not shown). In that instance, a counterweight line can be attached to the boom at a spaced distance from the pivot point, either above or below it, such that the line connection point passes closely by a sheave on the counterweight line, just outside the path of travel of the boom. Any such arrangement is within the principles of the present invention.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. A crane having a counterweighted luffing boom with protection against overbooming, as by excessive wind force when the boom is at a steep angle close to vertical, comprising:

a supporting structure;

a luffing boom pivotally mounted on the supporting structure at a pivot point;

a series of sheaves mounted on the supporting structure;

at least one counterweight and a line connected to the counterweight and over the sheaves to a connection with the boom at a point spaced from the boom's pivot point;

a portion of the supporting structure supporting one of the sheaves adjacent to but spaced sideward of the path of travel of the luffing boom and adjacent to the path of travel of the connection point of the line on the boom, said one sheave being the first sheave over which the line travels from the connection point on the boom and spaced forward of the vertical boom position, such that the line and the counterweight pull on the boom tending to swing it upward in its path of travel until the line connection point on the boom passes said one sheave, after which the boom is oriented steeply and close to vertical and the line loops further around said one sheave and the line and counterweight then pull on the boom in the opposite direction, tending to retard further upward travel.

2. The crane of claim 1, wherein the portion of the supporting structure comprises a pair of struts, one on either side of the path of swinging movement of the luffing boom, said one sheave being mounted on one strut and another similar sheave being mounted on the other strut in a position corresponding to that of said one sheave, there being a second line connected to the counterweight and passing over said similar sheave and connected to the boom at a location corresponding to said line connection point.

3. The crane of claim 1, wherein the crane's supporting structure includes a frame having an apex higher than and behind said one sheave, and an apex sheave mounted at the apex, with the line from the counterweight passing over the apex sheave and then obliquely downwardly and over said one sheave and to the connection with the boom, the boom being pivoted from one end, the line connection point being spaced from the boom's pivot point at such a distance that it passes under said one sheave when the boom approaches vertical, so that the line passes over, around and under the one sheave when the boom is past the one sheave and close to vertical.

4. The crane of claim 3, including a second, similar line connected to the counterweight and additional sheaves for the second line corresponding to and opposite said one sheave and said apex sheave, the two lines being connected to opposite left and right sides of the boom.

5. The crane of claim 1, wherein the line connection point and said one sheave are so located that the boom is at about 70° angle of inclination when the line connection point passes said one sheave.

* * * * *